US007602929B2

(12) United States Patent
Topholm et al.

(10) Patent No.: US 7,602,929 B2
(45) Date of Patent: Oct. 13, 2009

(54) METHOD OF CONNECTING AN ACCESSORY TO A HEARING AID AND THE COMBINATION OF AN ADAPTER AND AN ACCESSORY

(75) Inventors: Jan Topholm, Holte (DK); Morten Bent Nielsen, Frederiksberg (DK)

(73) Assignee: WIDEX A/S, Varlose (DK)

( * ) Notice: Subject to any disclaimer, the term of this patent is extended or adjusted under 35 U.S.C. 154(b) by 945 days.

(21) Appl. No.: 11/217,317

(22) Filed: Sep. 2, 2005

(65) Prior Publication Data

US 2006/0034474 A1 Feb. 16, 2006

Related U.S. Application Data

(63) Continuation-in-part of application No. PCT/DK03/00141, filed on Mar. 6, 2003.

(51) Int. Cl.
*H04R 25/00* (2006.01)

(52) U.S. Cl. ..... 381/322; 381/330

(58) Field of Classification Search ..... 381/312, 381/322, 324, 330
See application file for complete search history.

(56) References Cited

U.S. PATENT DOCUMENTS 5,188,540 A 2/1993 Haertl et al.
7,068,804 B2 * 6/2006 Batting ..... 381/330

FOREIGN PATENT DOCUMENTS

| | | | |
|---|---|---|---|
| CH | 675657 | A5 | 10/1990 |
| DE | 37 23 809 | A1 | 1/1989 |
| DE | 197 55 165 | C1 | 6/1989 |
| EP | 0 087 668 | A1 | 9/1983 |
| EP | 0 279 914 | A2 | 8/1988 |
| EP | 0 806 885 | A1 | 11/1997 |
| WO | WO 02/51203 | A1 | 6/2002 |
| WO | WO 02/51204 | A1 | 6/2002 |

* cited by examiner

*Primary Examiner*—Brian Ensey
(74) *Attorney, Agent, or Firm*—Sughrue Mion, PLLC

(57) ABSTRACT

A combination unit for attachment to a hearing aid includes an adapter and an accessory, having mating guideways, respective assembly pressure faces (14,29) adjacent the guideways and respective disassembly pressure faces (13, 30), also adjacent on the guideways. The adapter (2) includes a shoe, i.e. a sleeve-like structure, adapted to partially enclose the lower portion of the hearing aid. The accessory (3) may include a miniature FM receiver. The receiver housing (22) exterior is tailored to match the adapter exterior in order that the respective walls are flush when the parts are assembled. The combination unit (1) of the adapter and the accessory is easily assembled and easily disassembled, and is very compact. The invention provides a combination unit, including the shoe and the accessory, as well as a method for attaching an accessory to a hearing aid.

23 Claims, 10 Drawing Sheets

E-E

METHOD OF CONNECTING AN ACCESSORY TO A HEARING AID AND THE COMBINATION OF AN ADAPTER AND AN ACCESSORY

RELATED APPLICATIONS

The present application is a continuation-in-part of application No. PCT/DK2003/000141, filed on Mar. 6, 2003, in Denmark and published as WO 2004/080123 A1.

BACKGROUND OF THE INVENTION

1. Field of the Invention

The present invention relates generally to the field of hearing aids. The invention further relates to a combination of an adapter and an accessory for a hearing aid.

As used in this context, a hearing aid is understood as generally comprising a device with an input transducer for transforming an acoustic input signal into a first electrical signal, a signal processor for generating a second electrical signal based on the first electrical signal, an output transducer for conversion of the second signal into sound, and a battery for supplying power to the signal processor.

Within the present context, an adapter for a hearing aid designates a device for optional fastening to a hearing aid. The adapter usually serves the purpose of temporarily attaching equipment for use together with the hearing aid, for implementing some specific functionality not incorporated inside the hearing aid, or for providing a connection between the hearing aid and external equipment. The adapter may incorporate means for providing electrical connections to appropriate contact pads of the hearing aid.

An accessory of relevance to the invention comprises a radio receiver such as an FM receiver adapted for receiving an FM radio signal, converting the FM signal into an audio signal and providing the audio signal to the hearing aid, where the audio signal is fed into the hearing aid input circuitry. Other accessories of relevance comprise wireless receivers in general, infrared receivers, connectors for interfacing with other connector systems, audio cables for connection to an external source or another hearing aid, and a programming cable for programming the hearing aid.

2. The Prior Art

DE-30 32 311-A1 discloses a hearing aid with an electronic receiver. The receiver is adapted for receiving FM radio transmissions or infrared transmissions. The receiver attaches to the hearing aid and connects to contacts of the hearing aid. The receiver draws power from the hearing aid battery and supplies a signal to the amplifier.

U.S. Pat. No. 5,734,976 (an equivalent to EP-0 671 818-A1) discloses a micro-receiver for receiving a high frequency, frequency modulated or phase modulated signal adapted for being coupled to a hearing aid.

US Design Pat. D457,635 discloses a hearing aid with a module.

EP-0 806 885-A1 describes a holder for hearing aid accessory components. The holder has a housing open at the front which can be slid over one end of the hearing aid, and devices for removable attachment of the holder on the hearing aid. Electrically conducting leads run on the inside of the housing from the connecting points for the components to the front to make contact with conductors of the hearing aid. The connecting points provide opposing springs that ensure a mechanical and an electrical connection to the accessory component.

EP 0 087 668 A1 provides a hearing aid with a connection holder which is a self-impeding hook, the contacts of which, when hooked onto the case, engage contacts of the aid.

EP 0 334 837 B1 provides a hearing aid with an audio input plug, wherein the audio input connection is made via connecting elements holding together the detachable casing parts.

DE 93 06 204 U1 provides an adapter for a hearing aid, which connects to external pads of the hearing aid and receives a euro-plug.

A commercial implementation of an FM receiver comprises an FM receiver in a miniature cabinet, provided with an integral antenna and a plug. The plug engages a socket in an adapter shoe. The shoe is adapted for clamping onto the housing of a hearing aid. The shoe provides electrical connection to the hearing aid by means of springs adapted for contacting pads on the hearing aid. The user may attach the receiver to the shoe and then the assembly to the hearing aid, or he or she may assemble the parts in the opposite order. Various shoes are manufactured to accommodate different shapes and types of hearing aid housings, all for accommodating a standardized FM receiver.

In this commercial implementation, the receiver plug, referred to as a euro type audio plug, comprises three prongs, arranged in line on the top surface of the receiver housing. The prongs are differentiated in length and in diameter in order to ensure a uniquely defined engagement with the socket. The proper attachment is essential for obtaining the proper electrical connections and for the purpose of obtaining a specific orientation of the integral receiver antenna. The prongs or jacks are held in engagement by springs adapted to resist accidental withdrawal. As the receiver will normally depend from the hearing aid shoe with the prongs oriented vertically, the springs must maintain a firm grip to avoid accidental working loose of the prongs.

Although this design meets all technical requirements, there is a desire for a more convenient solution.

The differentiation among the prongs is not easily perceptible, creating a potential difficulty for a user attempting to identify the proper orientation for assembling the receiver and the adapter.

Pushing the plug into the socket requires a firm grip on the hearing aid for obtaining sufficient engagement, as the force generally must be applied solely by friction, and as the direction of the force required does not lie centrally of the hearing aid. Separating the parts requires a similar firm grip, as there is no face for easy engagement. The nature of these manipulations must be considered in the light of the typical users, who may be elderly people and perhaps people with impaired dexterity.

The socket occupies considerable space inside the adapter. The prongs need a firm structure below the receiver top surface for retention and support. This adds to the length of the composite assembly. The entire assembly has a rather irregular and bulky appearance.

SUMMARY OF THE INVENTION

It is an object of the invention to provide a combination which facilitates assembly by facilitating the user's orientation of the components before assembly.

It is a further object of the invention to provide a combination which permits miniaturization of the components and of the assembly.

It is a still further object of the invention to provide a combination that facilitates assembly and disassembly through permitting a tactile confirmation of the state of assembly or disassembly.

It is also an object of the invention to provide a combination that is easily assembled and disassembled, even for those with impaired finger agility.

It is a yet further object of the invention to provide a combination that provides an attractive appearance.

It is another object of the invention to provide a combination that is easily adapted to match a variety of hearing aid designs.

It is yet another object of the invention to provide a combination, that can easily be modified for compatibility with older connector systems.

The invention, in a first aspect, meets these object by providing a combination unit for attachment to a hearing aid, comprising an adapter shoe and an accessory, the adapter shoe having fastening means for mechanical engagement of the hearing aid, a first set of contact means for providing electrical contact to the hearing aid, gripping means for mechanically securing the accessory, and a second set of contact means, electrically connected to the first set of contact means and adapted for electrically contacting the accessory, the accessory having a set of accessory contact means for electrically contacting the second set of contact means, and, arranged laterally of the accessory contact means, catch means for mechanically engaging the gripping means, wherein the second set of contact means and the accessory contact means are arranged substantially in respective parallel planes, wherein at least one of the second set of contact means and the accessory contact means comprises resilient means for providing contact pressure substantially perpendicular to the parallel planes to ensure the electrical contact, and wherein the adapter shoe and the accessory are adapted to appear in the assembled state as a monolithic structure with flush walls.

Within this combination, the adapter engages the accessory by structure laterally of the contacts, i.e. generally towards both sides, e.g. along opposing edges. This ensures easy assembly. The lateral layout of the means for mechanical engagement ensures a stable engagement with minimal rocking at a minimum bulk of structure inside the adapter as well as inside the accessory. This lateral layout further permits the maximum of latitude in the arrangement of the electrical parts, e.g. conveniently grouping them together, anywhere on the accessory top side. Further, the adapter contacts and the accessory contacts are arranged substantially in respective parallel planes and adapted for supporting a contact pressure substantially perpendicular to the parallel planes. This simplifies design and manufacturing of the contacts, e.g. a whole bank of spring contacts, whether for the adapter or the accessory, can be manufactured by cutting and bending operations from a single blank of sheet metal. The design further achieves a reliable electrical contact.

A stable engagement may preferably be achieved by including in the gripping means and the catch means resilient means, such as resilient plastic parts of the adapter. Compatibility with older systems is achieved by dedicated inter-system conversion adapters.

According to a preferred embodiment, the gripping means and the catch means comprise mating guideways for sliding mutual engagement, respective assembly pressure faces adjacent the guideways and respective disassembly pressure faces adjacent the guideways. The mating guideways permit sliding the accessory into engagement with the adapter.

Pressure faces are arranged adjacent the guideways, i.e. generally close to the axis of displacement defined by the guideways. The pressure faces may be slightly offset from the axis of the guideways, in which event the user will have to rely on a combination of compression and friction in order to apply suitable force. In any case, the assembly pressure faces adjacent the guideways allow the user to apply the force required to push the parts into engagement with a soft finger grip, as the user does not have to rely entirely on friction between the fingers and the parts for applying the force. Similarly, the disassembly pressure faces adjacent the guideways allow the user to apply the force required to push the parts out of engagement with a soft finger grip, as the user does not have to rely entirely on friction between the fingers and the parts for applying the force.

This combination unit permits a very compact design, which is easily tailored to any specific hearing aid for a pleasant, total appearance.

Preferably, the assembly pressure faces and the disassembly pressure faces comprise respective wall portions of the adapter and the accessory, generally perpendicular to the axis defined by the guideways.

The guideways are easily identified and oriented for sliding assembly. Sliding the parts into engagement along the guideways facilitates tactile verification of the assembled state, e.g. by sensing the moment when the walls of the adapter and the accessory are flush.

Resilient means, e.g. springs, may be arranged for biasing the guideways in order to absorb any play between the parts. Thus, ample play may be arranged for easy assembly, without creating any undesirable effects, such as a sense of loose engagement.

The adapter may comprise a sleeve section with the cross-section appearing generally in the shape of a rectangle with rounded corners, generally adapted to fit the exterior of the lower part of the hearing aid. The adapter guideways are conveniently implemented by guides along opposing sleeve section edges, which simplifies the design of the adapter.

End stops and snap lock means may be provided for securing the mutual positions of the parts. The guides may be arranged to extend, in the wearing position, substantially in a horizontal direction in order that the snap lock means need not be adapted to carry the full weight of the accessory.

The invention, in a second aspect, provides an adapter shoe for interfacing between a hearing aid and an accessory, comprising fastening means for mechanical engagement of the hearing aid, a first bank of contacts for providing electrical contact to pads of the hearing aid, a second bank of contacts, electrically connected to the first bank of contacts and adapted for contacting contact pads of the accessory, and, arranged laterally of the second bank of contacts, gripping means for mechanically securing catch means of the accessory, wherein the second bank contacts are arranged substantially in a mutual plane and adapted for supporting a contact pressure substantially perpendicular to the plane, and wherein the adapter shoe is adapted to the accessory so as to appear together with the accessory in the assembled state as a monolithic structure with flush walls.

The invention, in a third aspect, provides an accessory for attachment by way of an adapter shoe to a hearing aid, comprising a bank of accessory contact pads for electrically contacting pads of the adapter shoe, and, arranged laterally of the accessory contact means, catch means for mechanically engaging gripping means of the adapter shoe, wherein the accessory contact pads are arranged substantially in a plane and are adapted for supporting a contact pressure substantially perpendicular to the plane, and wherein the accessory is adapted to the adapter shoe so as to appear together with the adapted shoe in the assembled state as a monolithic structure with flush walls.

The invention, in a fourth aspect, provides a combination unit for attachment to a hearing aid, comprising an adapter shoe and an accessory, the adapter shoe having fastening means for mechanical engagement of the hearing aid, a first set of contact means for providing electrical contact to the hearing aid, gripping means for mechanically securing the accessory, and a second set of contact means, electrically connected to the first set of contact means and adapted for electrically contacting the accessory, the accessory having a set of accessory contact means for electrically contacting the second set of contact means, and, arranged laterally of the accessory contact means, catch means for mechanically engaging the gripping means, wherein the second set of contact means and the accessory contact means are arranged substantially in respective parallel planes, wherein at least one of the second set of contact means and the accessory contact means comprises resilient means for providing contact pressure substantially perpendicular to the parallel planes to ensure the electrical contact, and wherein the adapter shoe and the accessory are adapted to appear in the assembled state as a monolithic structure with flush walls.

Particular embodiments of the invention appear from the dependent claims.

BRIEF DESCRIPTION OF THE DRAWINGS

The invention will now be described in more detail with reference to the accompanying drawings, where.

DETAILED DESCRIPTION

Figure 1:
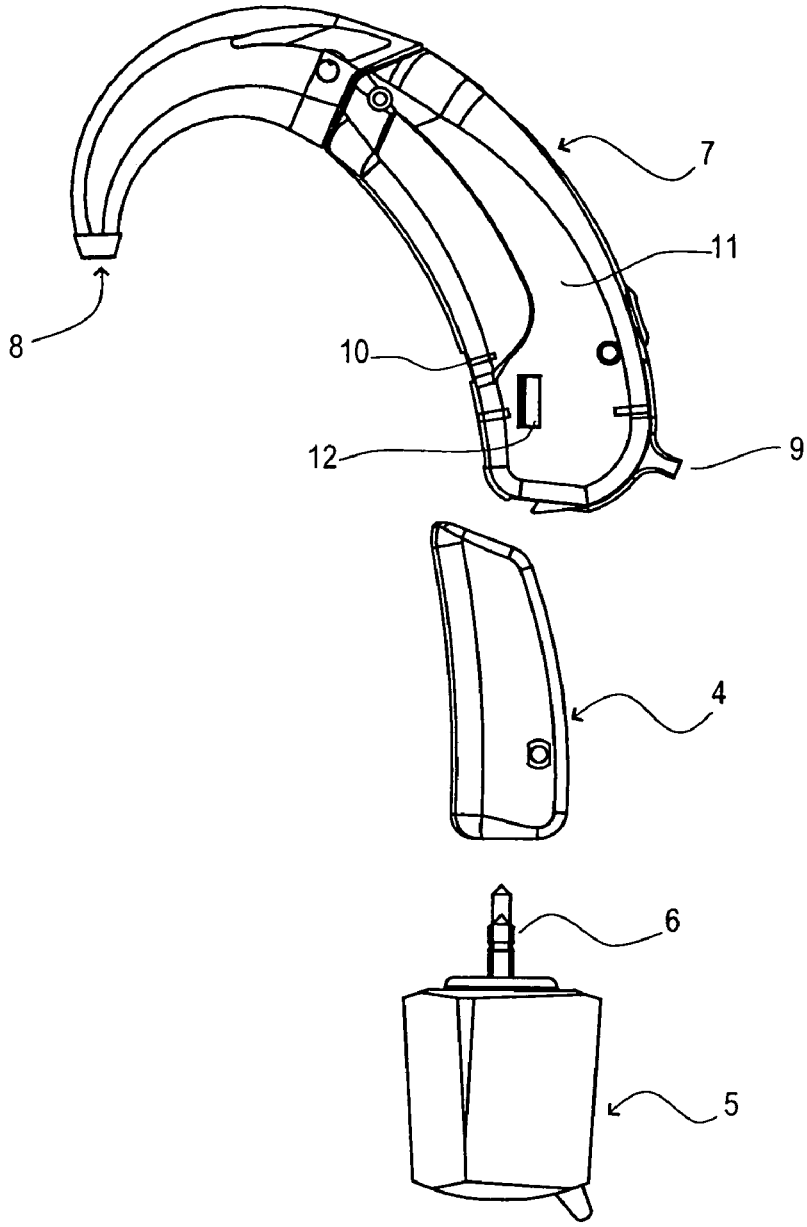
PRIOR ART Fig. 1
FIG. 1 illustrates an exploded view of a combination of a hearing aid, an adapter shoe and an FM receiver, all according to the prior art.
Figure 2:
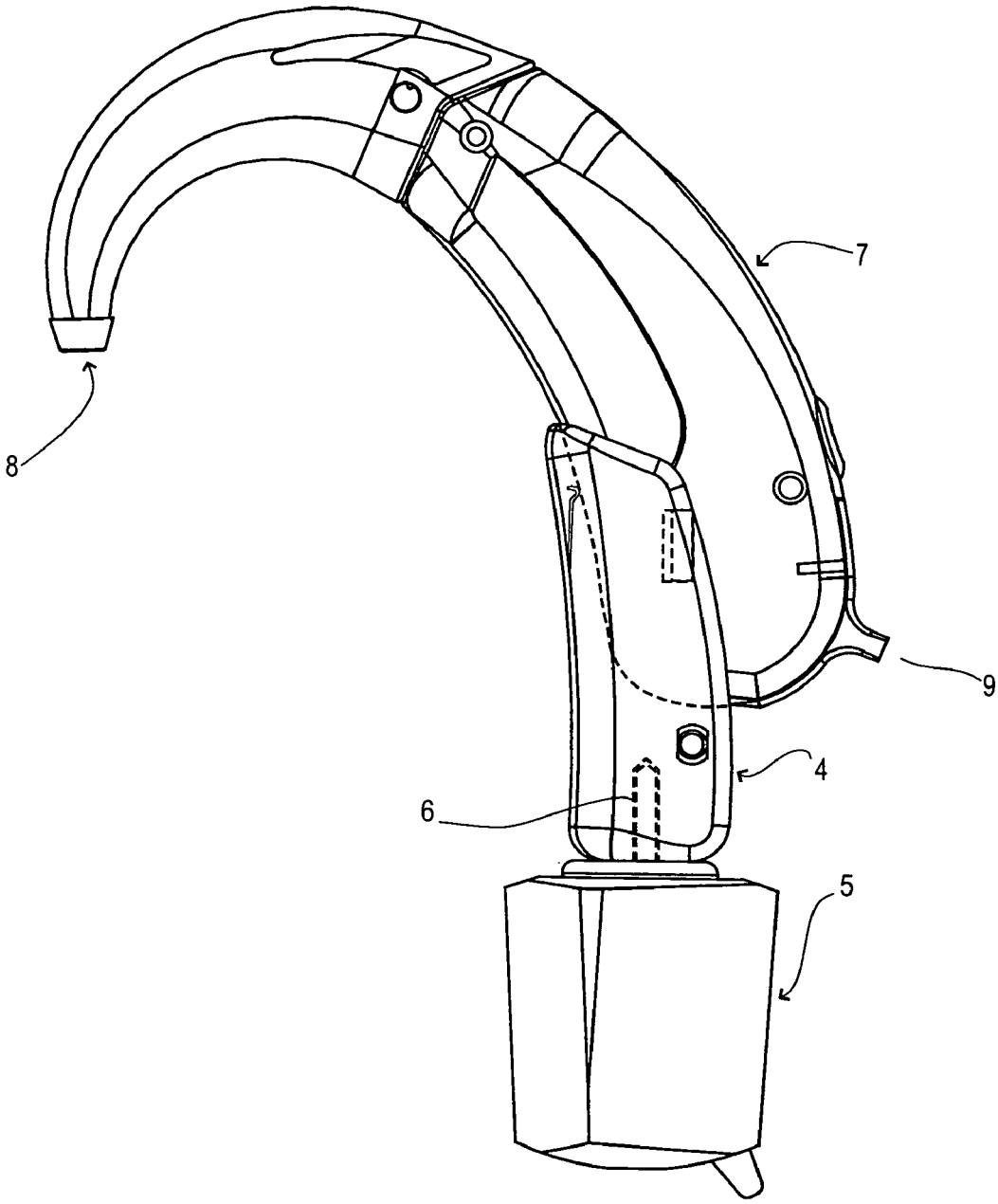
PRIOR ART Fig. 2
FIG. 2 illustrates an assembly of a hearing aid, an adapter shoe and an FM receiver, all according to the prior art.

Reference is first made to FIGS. 1 and 2, which illustrate a hearing aid 7, an adapter shoe 4 and an FM receiver 5, all according to the prior art; FIG. 1 showing these parts in exploded view whereas FIG. 2 shows the same parts in assembled state. The hearing aid 7 is a typical BTE, viz. Behind-The-Ear, type hearing aid, shown in the orientation as used, i.e. worn behind the ear. The hearing aid comprises sound output 8, switch 9, electrical contact pads 10 and hearing aid side walls 11 with shallow exterior recesses 12.

The adapter shoe 4 comprises a shoe-like structure with slightly resilient sides, adapted for engaging the lower portion of the hearing aid and fitted with inside protrusions (not shown) for engaging the hearing aid side recesses 12 in order to secure the grip. The adapter shoe comprises contact springs (not shown) for engaging the hearing aid contact pads 10. In the bottom, the adapter shoe is provided with a socket (not shown) for connection with an FM receiver.

The FM receiver 5 comprises a miniature FM electronic receiver fitted in a housing and provided with a three-pronged plug 6 in the top. The plug connects to the adapter shoe socket, in order to provide mechanical attachment as well as electrical connection.

Figure 3:
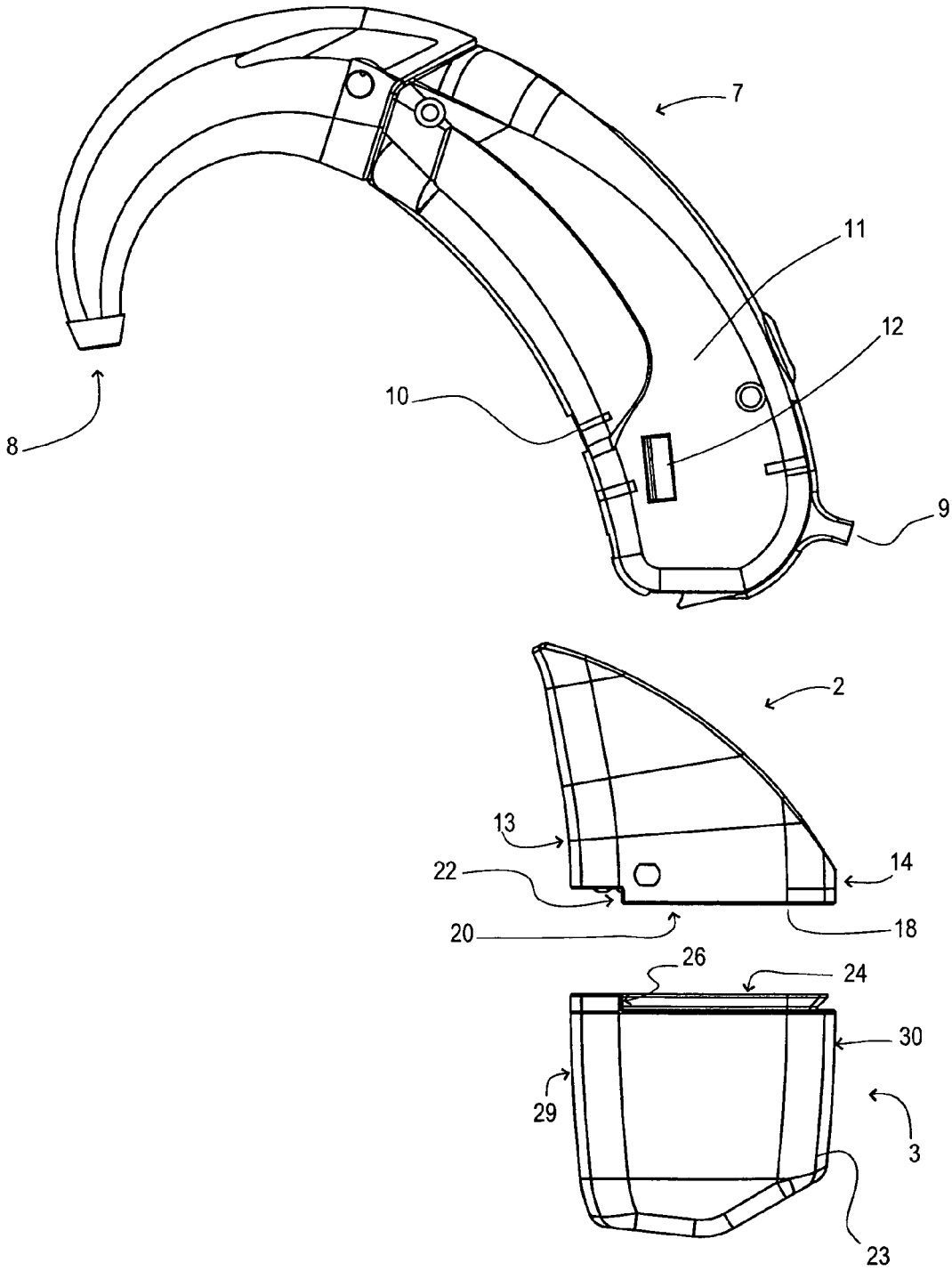
FIG. 3 illustrates an exploded view of a combination of a hearing aid, an adapter shoe and an FM receiver, all according to the invention.

Reference is now made to FIG. 3, which illustrates an exploded view of a combination of a hearing aid 7, an adapter shoe 2 and an accessory 3, according to the invention. The hearing aid is similar to the hearing aid shown in FIGS. 1 and 2, thus reference may be given to the above description of the hearing aid.

Figure 4:
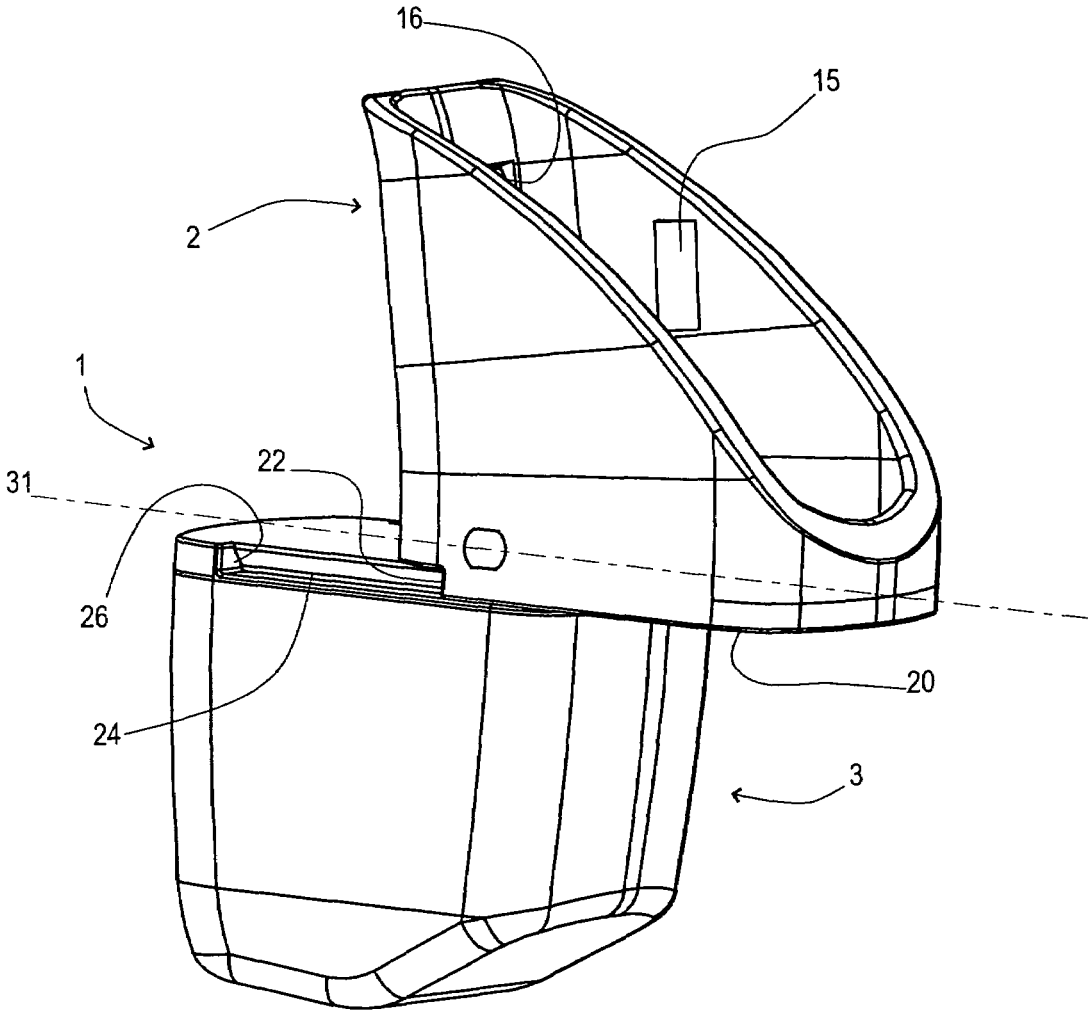
FIG. 4 illustrates a combination of an adapter shoe and an FM receiver, according to the invention and during a stage of assembly.
Figure 8:
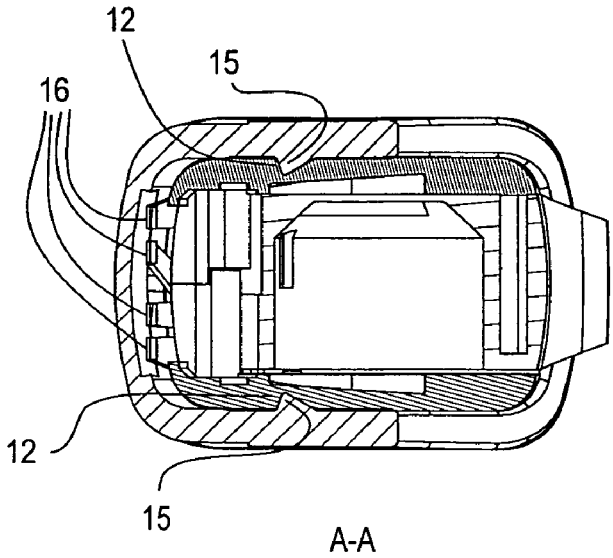
FIG. 8 illustrates a section in FIG. 5 by the plane A-A.
Figure 5:
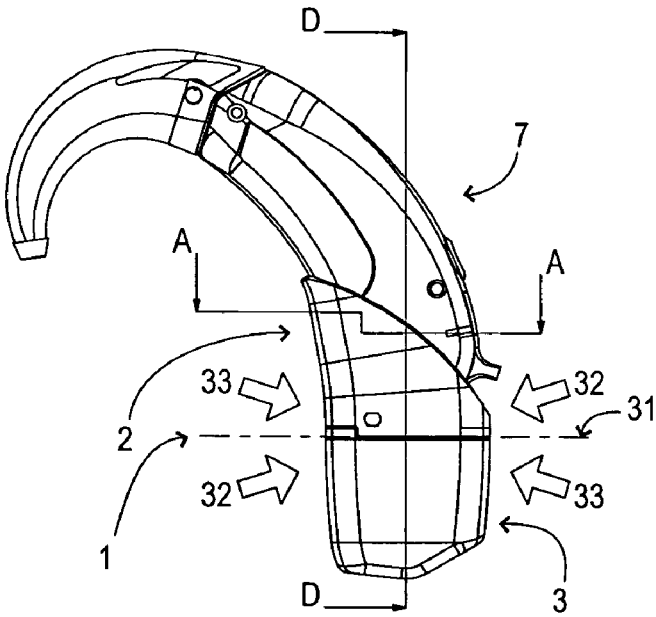
FIG. 5 is a side view of an assembly of a hearing aid, an adapter shoe and an FM receiver, all according to the invention.
Figure 6:
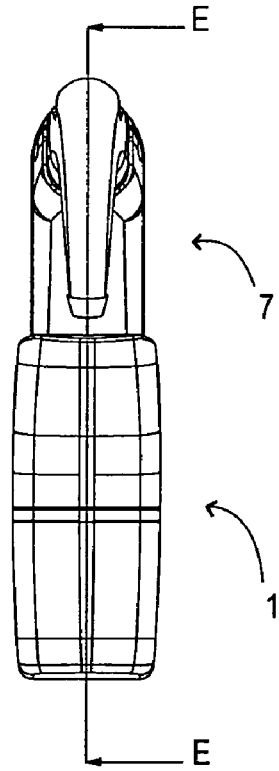
FIG. 6 illustrates the assembly of FIG. 5 in front view.
Figure 10:
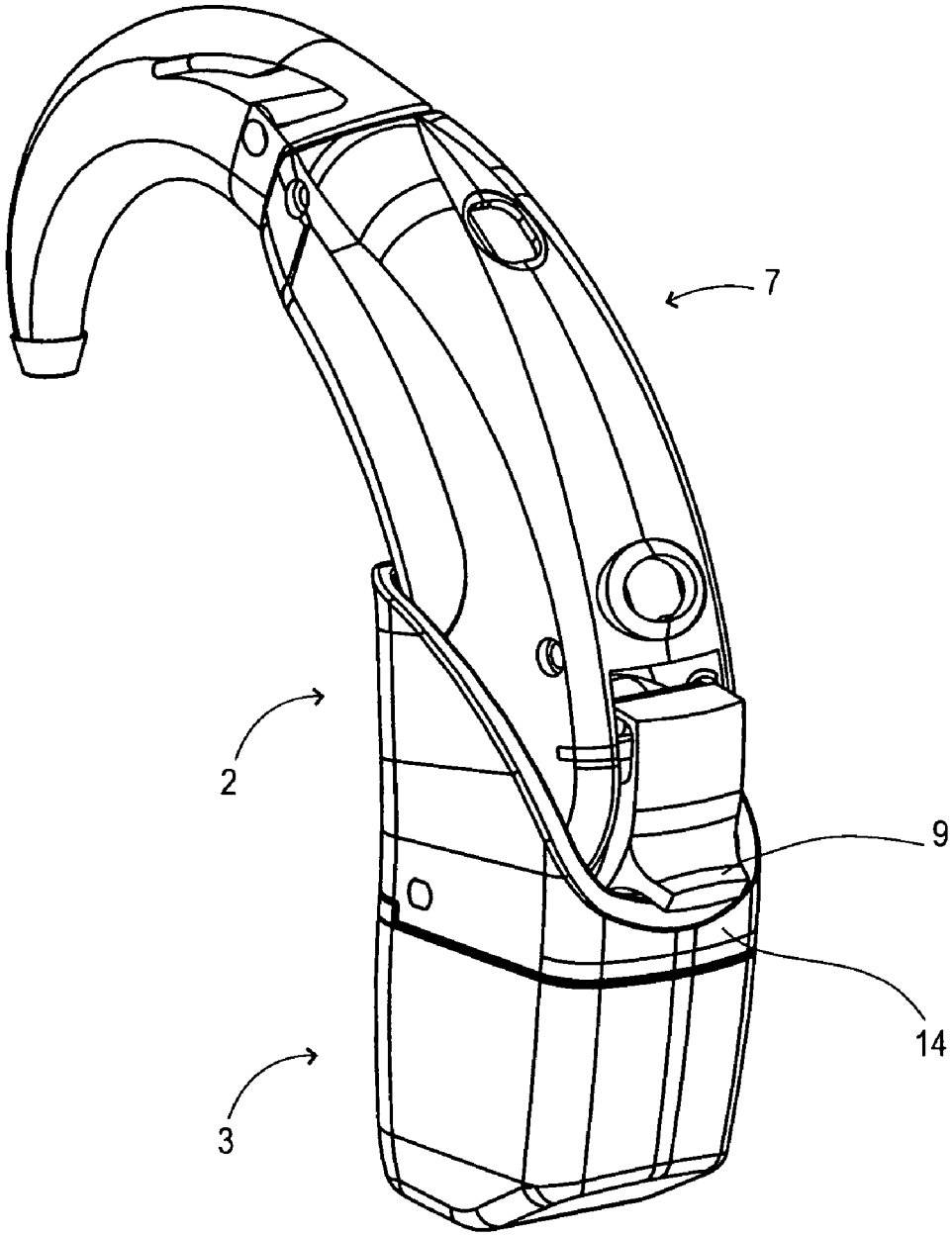
FIG. 10 illustrates the assembly of FIG. 5, in perspective view and with a switch in a different position.

The adapter shoe 2 comprises a sleeve-like structure, adapted to enclose the lower portion of the hearing aid, i.e. it has a cross-section appearing like a rectangle with rounded corners (Re. FIG. 8). Downwards, the sleeve is terminated along a transverse plane; upwards the sleeve is terminated by a slanted and curved plane, leaving a high front wall 13 (i.e. the wall intended to contact the concave side of the hearing aid) and a low rear wall 14. FIG. 4 shows a stage during assembling the adapter 2 and the accessory 3 to form together a combination unit 1. FIGS. 5 and 6 show the combination unit 1 mounted onto the hearing aid, and illustrates how the sleeve conceals the hearing aid side recesses 12 and the hearing aid contact pads, whereas access is left to the hearing aid power switch 9 (Re. FIG. 10).

The accessory 3 according to this embodiment of the invention comprises a miniature FM receiver fitted in a housing. This housing 23 has a generally flat top surface, a front wall 29 and a rear wall 30. The housing exterior is styled to match the appearance of the adapter shoe exterior in order that the respective walls are flush when the parts are assembled.

Figure 7:
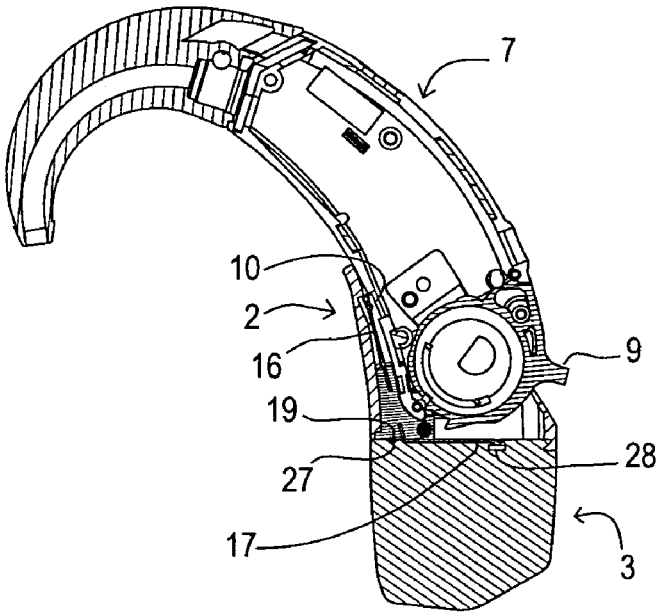
FIG. 7 illustrates a section in FIG. 6 by the plane E-E.

Reference is now made to FIG. 7 which shows a section in the assembly of FIG. 5. For ease of understanding, the section plane may be perceived as a plane of symmetry, however this symmetry solely applies to the general exterior and certainly not to details of the components. FIG. 7 illustrates in particular the positions of the hearing aid contact pads 10 and of the adapter upper cantilever springs 16, which engage the hearing aid pads for electrical contact.

FIG. 7 further shows the positions of the accessory contact pads 28 and of the adapter lower cantilever springs 17, which engage the accessory contact pads 28 for electrical contact. FIG. 7 also shows the cooperating engagement between the adapter cam 19 and the accessory cavity 27 for snap locking engagement.

FIG. 8 provides a section by the plane A-A in FIG. 5 for showing clearly the upper cantilever springs 16, arranged for engaging the hearing aid contact pads 10. FIG. 8 also shows the engagement between the hearing aid side recesses 12 and the adapter ribs 15 for retaining the adapter shoe 2 on the hearing aid 7.

Figure 9:
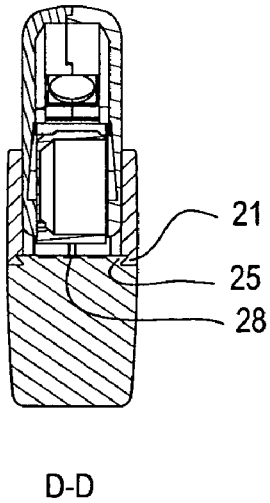
FIG. 9 illustrates a section in FIG. 5 by the plane D-D.

Reference is now made to FIG. 9, which shows a section with the line D-D in FIG. 5, through the hearing aid 7, the adapter shoe 2 and the accessory 3. FIG. 9 in particular shows the engagement between the gripping means, provided by the adapter guide faces 21, and the catch means, provided by the accessory guide faces 25.

Reference is made to FIG. 10, which is a perspective view of the assembly of FIG. 5, but with the hearing aid power switch 9 in a different position. This figure illustrates how the low adapter rear wall 14 leaves sufficient clearance for manipulating the switch 9 downwards, while the adapter shoe 2 and the accessory 3 remain attached to the hearing aid 7.

Figure 11:
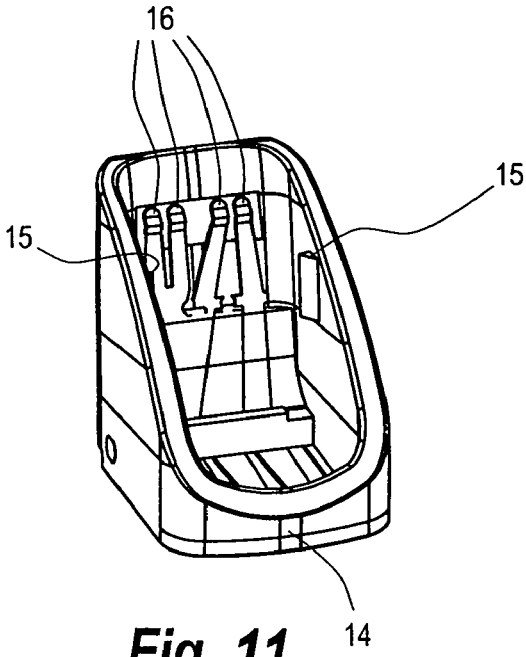
FIG. 11 illustrates an adapter shoe according to the invention in perspective view showing the rear and the upper side.
Figure 12:
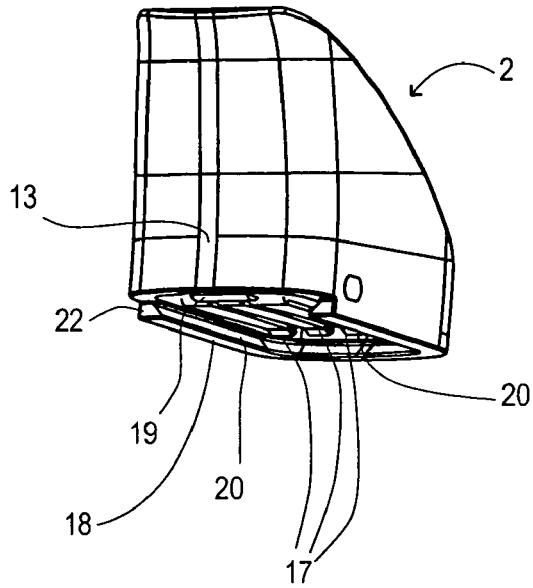
FIG. 12 illustrates an adapter shoe according to the invention in perspective view showing the front and the lower side.

Reference is made to FIGS. 11 and 12 for some details of the adapter shoe 2. FIGS. 11 and 12 illustrate the general appearance of the adapter shoe in the shape of a section of a sleeve with a cross-section in the shape of a rectangle with rounded corners and with open bottom. FIG. 11 illustrates cantilevered upper contact springs 16 arranged on the adapter front wall 13 inside, and a pair of opposing ribs 15 arranged on opposing insides of respective adapter side walls (Re. FIG. 7). The contacting springs are tailored to match the specific hearing aid, notably with respect to the layout of pads. In the embodiment of FIG. 11, the springs offer a bank of contacts arranged in line.

FIG. 12 illustrates the pair of parallel guides 20 at the adapter sleeve lower edge 18, which together provide the adapter guideways. FIG. 12 further shows adapter end stops 22 at the guides 20, and the adapter cam 19. FIG. 12 shows cantilevered adapter lower springs 17 adapted for engaging pads on the accessory top face. In the embodiment shown, the cantilevered springs run generally parallel to offer a bank of contacts, adapted to provide a spring force in a direction downwards away from the adapter, perpendicular to a plane spanned by the pair of guideways. This simplifies manufacturing and fitting of the springs.

Figure 13:
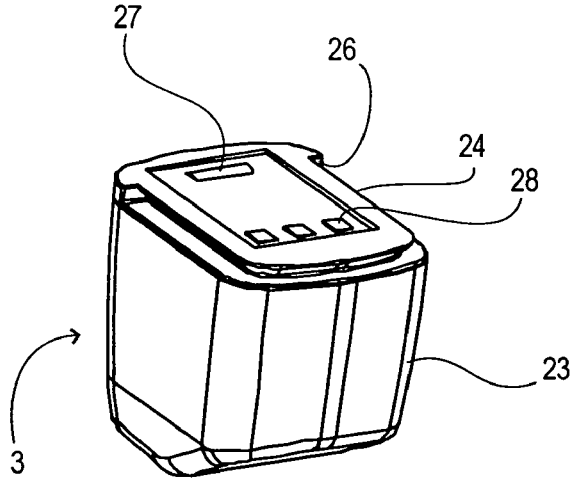
FIG. 13 illustrates an accessory according to the invention in perspective view showing the upper side.

Reference is made to FIG. 13 for some details of the accessory 3. Thus FIG. 13 shows catch means in the form of a pair of parallel accessory guides 24 at the top edge of the accessory housing 23, which guides together provide the accessory guideways. The accessory guideways comprise accessory end stops 26. The accessory is fitted with a cavity 27 and with a bank of electrical contact pads 28. The pads are adapted for supporting contact pressure in a direction generally downwards onto the accessory top and perpendicular to a plane spanned by the pair of accessory guides 24.

It is understood that the respective guides 20, 24 and end stops 22, 26 of the adapter shoe 2 and of the accessory 3 are adapted for cooperating engagement, permitting dovetailing the parts together by sliding them along guide way axis 31 until they reach the end stops 22, 26, where the cam 19 snaps into the accessory cavity 27. Resilience for snapping the cam 19 into the cavity 27 is provided by inherent resilience in the structure of the adapter guides 20 and the accessory guides 24, achieved by selecting for these parts materials with appropriate properties. The snapping creates a tactile confirmation of the engagement. Suitable materials for the resilient parts of the adapter shoe or of the accessory comprise polyamide, polycarbonate or cellulosic plastic.

The arrangement of the cooperating guides laterally of the contacts, i.e. adjacent the edges to both sides of the contacts, ensures a firm engagement, capable of resisting the contact pressure with no tendency of rocking between the parts. The adapter shoe and the accessory are styled and adapted to appear in the assembled state as a monolithic structure with flush walls. This creates an attractive aesthetic appearance. Further, the flush walls facilitate tactile verification of the assembled state of the parts.

Figure 14:
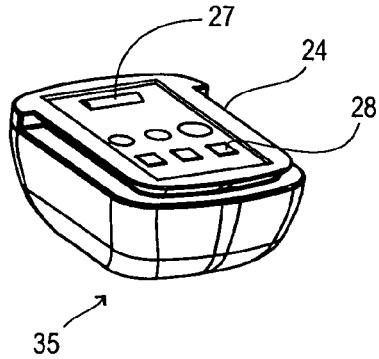
FIG. 14 is a perspective from above of a socket converter.
Figure 15:
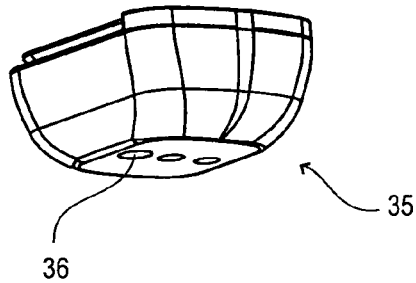
FIG. 15 is a perspective from below of the socket converter of FIG. 14.

Reference is now made to FIGS. 14 and 15 for an explanation of a second embodiment of the accessory according to the invention. This accessory is essentially a socket adapter 35, i.e. a socket connector for interfacing between the adapter shoe according to the invention and an accessory of the prior art equipped with a euro type plug. Thus the top side of this socket adapter is similar to the top side of the accessory 3 illustrated in FIG. 13, whereas the bottom side is fitted with bores 36 for receiving prongs of the euro type plug of the prior art accessory 5, similar to the bottom side of the adapter 4 in FIG. 1. The implementation of mechanical details as well as of suitable electrical connections will be obvious to those skilled in the art.

Figure 16:
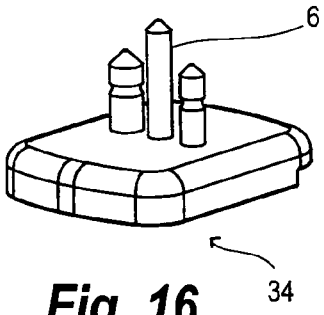
FIG. 16 is a perspective from above of a plug converter.
Figure 17:
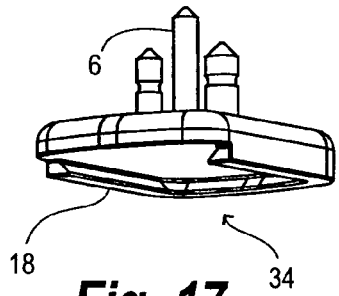
FIG. 17 is a perspective from below of the plug converter of FIG. 16.

Reference is now made to FIGS. 16 and 17 for an explanation of a plug adapter 34 for use together with an accessory according to the invention. The plug adapter 34 is adapted for fitting onto the accessory according to the invention and for providing on the top side a plug connector for interfacing with euro type sockets used on adapters of the prior art 4. The bottom side is similar to the bottom side of the adapter 2 in FIG. 12, whereas the top side is similar to the top side of the accessory 5 in FIG. 1. The implementation of mechanical details as well as of suitable electrical connections will be obvious to those skilled in the art.

Figure 19:
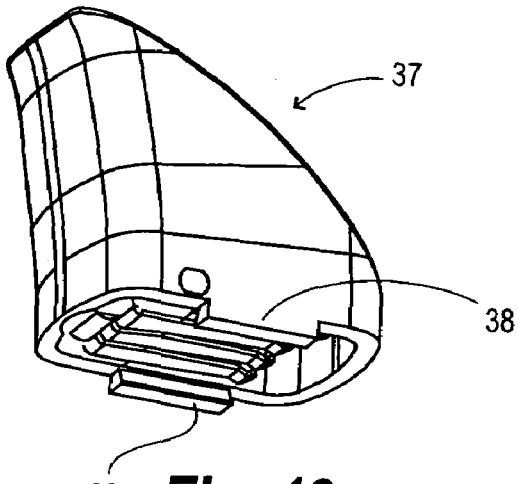
FIG. 19 is a view similar to FIG. 12 but showing the click-on adapter.
Figure 18:
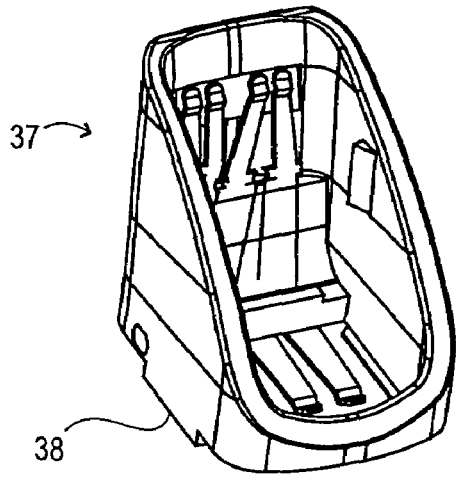
FIG. 18 is a view similar to FIG. 11 but showing a click-on adapter.

Reference is now made to FIGS. 18 and 19 for a description of an embodiment of the adapter shoe designated as a click-on type adapter 37. This click-on adapter is fitted with gripping means in the form of claws 38 for engaging suitable, complementary parts of an accessory. The claws are adapted for clicking onto, rather than sliding onto, the complementary parts of the accessory. The claws are arranged laterally of the contact springs and serve to secure a firm grip on the accessory. Other parts are similar to parts of the embodiment in FIG. 11, and thus reference may be had to the above explanation.

Figure 20:
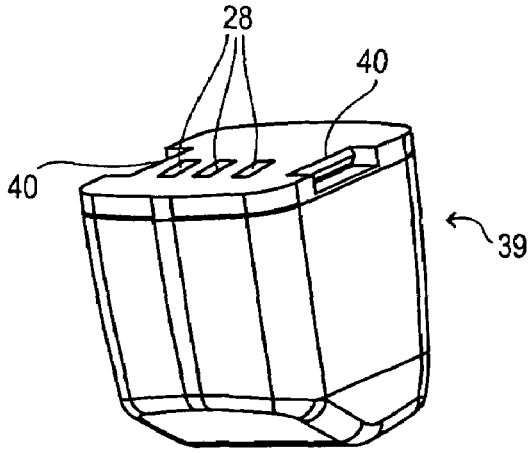
FIG. 20 is a perspective of a click-on accessory, showing the lower side.

Reference is now made to FIG. 20 for a description of an embodiment of the accessory according to an embodiment designated as a click-on type accessory. This click-on accessory is adapted for cooperating with the click-on adapter shown in FIGS. 18 and 19. The click-on accessory 39 features catch means in the form of click-on recesses 40 for cooperating with claws of the click-on adapter. The claws and the click-on recesses provide guides for securing a well-defined mutual positioning and orientation of the parts connected.

Reference is now made to FIGS. 3, 4 and 5 for an explanation of the operations for assembling and disassembling the parts. As mentioned above, FIG. 3 shows the parts in exploded view, i.e. in a state completely separated. For the purpose of assembling the adapter shoe 2 and the accessory 3, the respective guides are registered and the parts are slid into engagement by applying suitable pressure. FIG. 4 illustrates an intermediate stage during this sliding process.

For sliding the parts together, an assembly pressure force 32 (re. FIG. 5) is applied onto the adapter rear wall 14, which establishes the adapter assembly pressure face, and onto the accessory front wall 29, which establishes the accessory assembly pressure face. As the pressure faces are not located exactly on the axis 31 defined by the guideways, the direction of the pressure forces is slightly offset from the direction perpendicular to the pressure faces, requiring the user to hold the parts. However, only a soft grip is required to stabilize the hold on the parts, as the forces are predominantly pressure forces.

Once the parts have been driven fully home in the guides, adapter end stops 22 engage accessory end stops 26, limiting the excursion, and the cam 19 snaps into the accessory cavity 27 to secure the position. In the assembled state, the adapter lower cantilever springs 17 engage the accessory pads 28, creating a transverse bias on the guides. This absorbs any play in the guides and keeps the parts in a steady mutual engagement. In the embodiment illustrated in the figures, the guides have oblique adapter guide faces 21 and matching, oblique accessory guide faces 25, in order that the pretension by the springs 17 will create a wedging effect, enhancing friction in the guides.

The assembly or combination unit 1 comprising the adapter shoe 2 and the accessory 3 may subsequently be attached onto the hearing aid 7 by pressing the adapter shoe 2 onto the hearing aid housing, the adapter side walls yielding resiliently until the adapter ribs 15 can snap into the side recesses 12 to secure the grip. In this position, the adapter upper springs engage the hearing aid contact pads 10 to establish electrical connections.

Inside the adapter shoe 2, the upper springs and the lower springs 17 are electrically connected in order that the adapter shoe 2 may provide electrical interfacing between the hearing aid contact pads 10 and the accessory contact pads 28. In one embodiment, these connections comprise two conductors for providing power from a battery inside the hearing aid 7 to the accessory 3, and a third conductor for forwarding an audio signal from the accessory 3 to the hearing aid input circuitry.

Other embodiments may feature a different number and a different lay-out of contacts to suit hearing aids or accessories with a different number or a different lay-out of contacts. The adapter shoe illustrated in the figures actually features four upper cantilever springs, adapted for engaging four contact pads of the hearing aid. For an accessory as illustrated in the figures, only three of these might be used, whereas another accessory, e.g. a plug for a programming cable, might use all four leads.

Disassembly of the parts is achieved by generally reversing the set of assembly manipulations. To disassemble the adapter shoe and the accessory, a disassembly pressure force 33 (re. FIG. 5) is applied onto the adapter front wall 13, which constitutes the adapter disassembly pressure face, and onto the accessory rear wall 30, which constitutes the accessory disassembly pressure face.

In a further embodiment, the adapter shoe comprises lower stationary contact pads rather than springs, whereas the accessory comprises contact springs rather than stationary contact pads. Implementation of this embodiment will be evident to those skilled in the art, when relying on the above description.

Although just one type of hearing aid has been illustrated, it will be obvious to those skilled in the art to provide other adapters modified to suit other types of hearing aids, accommodating other shapes, arrangements of recesses and protrusions as well as other arrangements of electrical contact pads etc.

Although just a single type of accessory has been illustrated, it will be obvious to those skilled in the art to provide other types of accessories, such as connectors for audio cables or programming cables, or other types of electronic receivers, relying on the principles of the invention.

We claim:

1. A combination unit for attachment to a hearing aid, comprising an adapter shoe and an accessory, the adapter shoe having fastening means for mechanical engagement of the hearing aid, a first set of contact means for providing electrical contact to the hearing aid, gripping means for mechanically securing the accessory, and a second set of contact means, electrically connected to the first set of contact means and adapted for electrically contacting the accessory, the accessory having a set of accessory contact means for electrically contacting the second set of contact means, and, arranged laterally of the accessory contact means, catch means for mechanically engaging the gripping means, wherein the second set of contact means and the accessory contact means are arranged substantially in respective parallel planes, wherein at least one of the second set of contact means and the accessory contact means comprises resilient means for providing contact pressure substantially perpendicular to the parallel planes to ensure the electrical contact, and wherein the adapter shoe and the accessory are adapted to appear in the assembled state as a monolithic structure with flush walls.

2. The combination unit according to claim 1, wherein the gripping means comprise a pair of opposing, parallel adapter guides, spaced from the second set of contact means.

3. The combination unit according to claim 1, wherein the catch means comprise a pair of opposing, parallel accessory guides, spaced from the accessory contact means.

4. The combination unit according to claim 1, wherein the gripping means and the catch means comprise mating guideways for sliding mutual engagement, respective assembly pressure faces adjacent the guideways, and respective disassembly pressure faces adjacent the guideways.

5. The combination unit according to claim 4, wherein the adapter assembly pressure face comprises a first wall portion of the adapter shoe, and wherein the adapter disassembly pressure face comprises a second wall portion of the adapter shoe.

6. The combination unit according to claim 4, wherein the accessory assembly pressure face comprises a first wall portion of the accessory, and wherein the accessory disassembly pressure face comprises a second wall portion of the accessory.

7. The combination unit according to claim 1, wherein the first set of contact means comprises a contact spring for providing electrical contact to a pad on a hearing aid.

8. The combination unit according to claim 4, wherein the guideways comprise a pair of generally linear adapter guides and wherein the adapter shoe comprises a sleeve section structure, with the adapter guides arranged along a pair of generally opposing section edges.

9. The combination unit according to claim 4, wherein the guideways comprise cooperating end stops for limiting the mutual sliding of the adapter shoe and the accessory.

10. The combination unit according to claim 1, wherein at least one of the gripping means and the catch means comprises spring loaded means for snap locking mutual engagement between the adapter shoe and the accessory.

11. An adapter shoe for interfacing between a hearing aid and an accessory, comprising fastening means for mechanical engagement of the hearing aid, a first bank of contacts for providing electrical contact to pads of the hearing aid, a second bank of contacts, electrically connected to the first bank of contacts and adapted for contacting contact pads of the accessory, and, arranged laterally of the second bank of contacts, gripping means for mechanically securing catch means of the accessory, wherein the second bank contacts are arranged substantially in a mutual plane and adapted for supporting a contact pressure substantially perpendicular to the plane, and wherein the adapter shoe is adapted to the accessory so as to appear together with the accessory in the assembled state as a monolithic structure with flush walls.

12. The adapter shoe according to claim 11, comprising resilient means for biasing the accessory engaged by the gripping means in order to absorb any play.

13. The adapter shoe according to claim 11, wherein the gripping means comprise adapter guideways for mating engagement with the catch means, an adapter assembly pressure face adjacent the adapter guideways and an adapter disassembly pressure face adjacent the adapter guideways.

14. The adapter shoe according to claim 13, wherein the adapter assembly pressure face comprises a first wall portion of the adapter shoe, and wherein the adapter disassembly pressure face comprises a second wall portion of the adapter shoe.

15. The adapter shoe according to claim 13, wherein the adapter guideways comprise a pair of generally linear guides, and wherein the adapter shoe comprises a sleeve section structure, with the guides arranged along a pair of generally opposing section edges.

16. The adapter shoe according to claim 11, comprising spring loaded means for snap locking mutual engagement between the adapter shoe and the accessory.

17. The adapter shoe according to claim 13, wherein the adapter guideways comprise end stops for limiting the sliding of the accessory.

18. An accessory for attachment by way of an adapter shoe to a hearing aid, comprising a bank of accessory contact pads for electrically contacting pads of the adapter shoe, and, arranged laterally of the accessory contact means, catch means for mechanically engaging gripping means of the adapter shoe, wherein the accessory contact pads are arranged substantially in a plane and are adapted for supporting a contact pressure substantially perpendicular to the plane, and wherein the accessory is adapted to the adapter shoe so as to appear together with the adapted shoe in the assembled state as a monolithic structure with flush walls.

19. The accessory according to claim 18, comprising accessory guideways for mating engagement with guideways of the adapter shoe, an accessory assembly pressure face adjacent the accessory guideways and an accessory disassembly pressure face adjacent the accessory guideways.

20. The accessory according to claim 19, wherein the accessory assembly pressure face comprises a first wall portion of the accessory, and wherein the accessory disassembly pressure face comprises a second portion of the accessory.

21. The accessory according to claim 18, comprising resilient means for biasing the adapter shoe engaged in the catch means in order to absorb any play.

22. The accessory according to claim 21, wherein the resilient means comprises a contact spring for providing an electrical connection between the adapter shoe and the accessory.

23. A combination unit for attachment to a hearing aid, comprising an adapter shoe and an accessory, the adapter shoe having fastening means for mechanical engagement of the hearing aid, a first set of contact means for providing electrical contact to the hearing aid, gripping means for mechanically securing the accessory, and a second set of contact means, electrically connected to the first set of contact means and adapted for electrically contacting the accessory, the accessory having a set of accessory contact means for electrically contacting the second set of contact means, and, arranged laterally of the accessory contact means, catch means for mechanically engaging the gripping means, wherein the second set of contact means and the accessory contact means are arranged substantially in respective parallel planes, wherein at least one of the second set of contact means and the accessory contact means comprises resilient means for providing contact pressure substantially perpendicular to the parallel planes to ensure the electrical contact, and wherein the adapter shoe and the accessory are adapted to appear in the assembled state as a monolithic structure with flush walls.

* * * * *

UNITED STATES PATENT AND TRADEMARK OFFICE

CERTIFICATE OF CORRECTION

PATENT NO. : 7,602,929 B2
APPLICATION NO. : 11/217317
DATED : October 13, 2009
INVENTOR(S) : Topholm et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1076 days.

Signed and Sealed this

Fifth Day of October, 2010

David J. Kappos

David J. Kappos
*Director of the United States Patent and Trademark Office*